US008599011B2

(12) United States Patent
Schantz et al.

(10) Patent No.: US 8,599,011 B2
(45) Date of Patent: Dec. 3, 2013

(54) FIREFIGHTER LOCATION AND RESCUE EQUIPMENT EMPLOYING PATH COMPARISON OF MOBILE TAGS

(75) Inventors: Hans Gregory Schantz, Hampton Cove, AL (US); Michael Jason Meares, Huntsville, AL (US); Stephen A. Werner, Huntsville, AL (US); Alfred Hans Unden, Owens Cross Roads, AL (US); Clark David Della Silva, Huntsville, AL (US); Jason Kai Siang Kang, Morganville, NJ (US)

(73) Assignee: Q-Track Corporation, Huntsville, AL (US)

( * ) Notice: Subject to any disclaimer, the term of this patent is extended or adjusted under 35 U.S.C. 154(b) by 425 days.

(21) Appl. No.: 13/021,711

(22) Filed: Feb. 4, 2011

(65) Prior Publication Data

US 2012/0025977 A1 Feb. 2, 2012

Related U.S. Application Data

(60) Provisional application No. 61/400,645, filed on Jul. 30, 2010.

(51) Int. Cl.
*G08B 21/00* (2006.01)

(52) U.S. Cl.
USPC ..... 340/539.13; 340/572.1; 340/573.1; 455/414.1; 455/414.2

(58) Field of Classification Search
USPC ..... 340/539.13, 572.1, 573.1, 10.1; 455/414.1, 414.2
See application file for complete search history.

(56) References Cited

U.S. PATENT DOCUMENTS

| | | | |
|---|---|---|---|
| 716,134 | A | 12/1902 | Stone |
| 749,436 | A | 1/1904 | De Forest |
| 758,517 | A | 4/1904 | De Forest |
| 1,183,802 | A | 5/1916 | De Forest |
| 2,884,628 | A | 4/1959 | Loomis |
| 5,510,801 | A | 4/1996 | Engelbrecht |
| 5,977,913 | A | 11/1999 | Christ |
| 6,011,515 | A | 1/2000 | Radcliffe et al. |
| 6,026,304 | A | 2/2000 | Hilsenrath |

(Continued)

OTHER PUBLICATIONS

Fisher—"The Navigation Potential of Signals of Opportunity-Based Time Difference of Arrival Measurements", Air Force Institute of Technology (2005).

(Continued)

*Primary Examiner* — Jeffery Hofsass
(74) *Attorney, Agent, or Firm* — James Richards

(57) ABSTRACT

The present application describes firefighter location and rescue equipment (FLARE) comprising: a plurality of tag transmitters, a first tag transmitter of said plurality of tag transmitters emitting a first signal, a plurality of locator-receivers receiving said first signal, each of said plurality of locator receivers determining a first set of signal characteristic data for said first signal, a computer compiling said first set of signal characteristic data in a reference database along with an associated path variable, a second tag transmitter of said plurality of tag transmitters emitting a second signal, a plurality of locator-receivers receiving said second signal, each of said plurality of locator receivers determining a second set of signal characteristic data for said second signal, said computer comparing said second set of signal characteristic data to the reference database, said computer displaying said comparison for evaluating the location of said second tag transmitter relative to a path taken by said first tag transmitter.

27 Claims, 13 Drawing Sheets

(56) References Cited

U.S. PATENT DOCUMENTS

| | | | |
|---|---|---|---|
| 6,064,339 | A | 5/2000 | Wax |
| 6,104,344 | A | 8/2000 | Wax |
| 6,108,557 | A | 8/2000 | Wax |
| 6,112,095 | A | 8/2000 | Wax |
| 6,154,657 | A | 11/2000 | Grubeck |
| 6,230,000 | B1 | 5/2001 | Tayloe |
| 6,249,680 | B1 | 6/2001 | Wax |
| 6,282,426 | B1 | 8/2001 | Wang |
| 6,456,239 | B1 | 9/2002 | Werb |
| 6,496,701 | B1 | 12/2002 | Chen |
| 6,559,800 | B2 | 5/2003 | Rabinowitz |
| 6,608,593 | B2 | 8/2003 | Holt |
| 6,674,403 | B2 | 1/2004 | Gray |
| 6,691,074 | B1 | 2/2004 | Moriya |
| 6,727,847 | B2 | 4/2004 | Rabinowitz |
| 6,879,286 | B2 | 4/2005 | Rabinowitz |
| 6,963,301 | B2 | 11/2005 | Schantz |
| 6,963,727 | B2 | 11/2005 | Shreve |
| 7,043,999 | B2 | 5/2006 | Bernhard |
| 7,298,314 | B2 | 11/2007 | Schantz |
| 7,307,595 | B2 | 12/2007 | Schantz |
| 7,414,571 | B2 | 8/2008 | Schantz |
| 7,538,715 | B2 | 5/2009 | Langford |
| 7,592,949 | B2 | 9/2009 | Schantz |
| 7,593,740 | B2 | 9/2009 | Crowley |
| 7,609,164 | B2 | 10/2009 | Yamashita |
| 7,782,256 | B2 | 8/2010 | Smith |
| 7,809,805 | B2 | 10/2010 | Stremel |
| 7,859,452 | B2 | 12/2010 | Schantz |
| 2002/0196188 | A1 | 12/2002 | Holt |
| 2004/0032363 | A1 | 2/2004 | Schantz et al. |
| 2005/0046608 | A1 | 3/2005 | Schantz et al. |
| 2006/0244673 | A1 | 11/2006 | Schantz |
| 2007/0282482 | A1 | 12/2007 | Schantz |
| 2008/0241805 | A1 | 10/2008 | Schantz |
| 2009/0146864 | A1 | 6/2009 | Zank |
| 2009/0280742 | A1 | 11/2009 | Schantz |

OTHER PUBLICATIONS

Hall—"Radiolocation Using AM Broadcast Signals: The Role of Signal Propagation Irregularities", MIT Lincoln Laboratory, Lexington, MA, IEEE (2004).

Hertz—"Electric Waves", London: Macmillan and Company, p. 152 (1893).

Jenkins—"Small-Aperture Radio Direction-Finding", Artech House, Boston, pp. 1-23 (1991).

McEllroy—"Opportunistic Navigation: Finding Your Way With AM Signals of Opportunity", GPS World (2007).

Schantz—"Near Field Phase Behavior", IEEE Antennas and Propagation Society International Symposium, Washington, DC, USA; vol. 3B, pp. 134-137 (2005).

Schantz—"A Near Field Propagation Law & A Novel Fundamental Limit to Antenna Gain Versus Size", IEEE Antennas and Propagation Society International Symposium, Washington, DC, USA; vol. 3A, pp. 237-240 (2005).

Shantz—"On the Origins of RF-Based Location," Submitted to 2010 IEEE Symposium on RFID; Orlando, FL; (Apr. 14-15, 2010).

Yan—"Asynchronous Differential TDOA for Non-GPS Navigation Using Signals of Opportunity", ECE Department, University of Cincinnati, Cincinnati, Ohio IEEE (2008).

Hall—"Radiolocation Using AM Broadcast Signals", PhD Thesis, Massachusetts Institute of Technology (Sep. 2002).

602

604

606

608

610

612

614
616

620
618

624
622

628
626

630

FIREFIGHTER LOCATION AND RESCUE EQUIPMENT EMPLOYING PATH COMPARISON OF MOBILE TAGS

RELATED APPLICATIONS

The present application claims the benefit under 35 USC 119(e) of prior provisional application 61/400,645 titled: "Firefighter Location and Rescue Equipment," filed Jul. 30, 2010 by Schantz, which is incorporated herein by reference in its entirety.

FIELD OF THE INVENTION

The present invention pertains to the field tracking and location systems, more particularly, to a tracking system utilizing utilizing radio field information for use in search and rescue operations, as may be used by, for example, firefighters.

BACKGROUND

According to the US Bureau of Labor Statistics, in the United States, there are approximately 365,600 paid fire fighting positions; 70% of fire companies are staffed entirely by volunteers. Hence, there are approximately 1,216,666 fire fighters in the United States. As published in "Fire Chief," Mar. 25, 2005, the economic cost for fire fighter injuries is $2.7 billion to $7.8 billion per year. Thus, there is a substantial need for a system that can locate and aid in the rescue of firefighters. Two examples will help drive home this point.

The first example involves the 2007 fire in Charleston, S.C. that claimed the lives of nine fire fighters. The fire occurred in a huge furniture showroom and warehouse. More than a dozen firefighters rushed inside to attack the flames. The building was loaded with flammable furniture, it had no sprinklers, and its steel truss roof allowed the fire to spread deceptively fast. As the smoke thickened and the firefighters' air supplies began to run low, several of the men apparently became disoriented and could not find their way out through the maze of furniture. By the time the incident commander ordered his men to flee the store, it was too late. If the fire fighters had had a location system, they could have navigated out of the warehouse.

The second example involves the 1999 fire in Worcester, Mass. that claimed the lives of six fire fighters. It started when a homeless individual knocked over a candle in an abandoned warehouse. The individual fled without reporting the fire. Thinking homeless individuals may still be in the warehouse, fire fighters undertook search operations. The search mission was extremely difficult because of the large size of the warehouse; the lack of windows; and easily combustible materials. Disoriented, the fire fighters could not find their way out of the warehouse.

In short, there exists a significant need for firefighter location awareness in support of situational awareness and rescue operations.

SUMMARY OF THE INVENTION

The present application describes firefighter location and rescue equipment (also referred to herein as FLARE) comprising: a plurality of tag transmitters, a first tag transmitter of said plurality of tag transmitters emitting a first signal, a plurality of locator-receivers receiving said first signal, each of said plurality of locator receivers determining a first set of signal characteristic data for said first signal, a computer compiling said first set of signal characteristic data as in a reference database as a function of a path traveled, the path may be measured in time or distance, a second tag transmitter of said plurality of tag transmitters emitting a second signal, a plurality of locator-receivers receiving said second signal, each of said plurality of locator receivers determining a second set of signal characteristic data for said second signal, said computer comparing said second set of signal characteristic data to a reference database, said computer using said comparison to evaluate the location of said second tag transmitter relative to a path taken by said first tag transmitter.

In one embodiment the transmitter and receivers utilize near field signals.

In one embodiment, the comparison may comprise an error vector process. The comparison may be based on phase angle measurements and amplitude measurements of the signals.

In one embodiment a display is generated showing the comparison value as a function of a path variable. The path variable may be based on time elapsed or distance traveled. The display may be displayed at the location of the rescue tag and/or may be displayed at a central location.

In one embodiment the display may comprise a graph of the comparison value. In another embodiment, the display may comprise a color bar indicating the comparison value as a color associated with each path value.

The color bar may represent the comparison value as a function of path location.

The color of the color bar may be a gray scale or a non-gray color scheme.

In one embodiment, the system may generate an audio indication associated with the second transmitter tag (rescue tag) indicating relative comparison of the second transmitter signal to the database of first transmitter signals.

The invention further includes a method of using the location system comprising the steps of: generating a dataset of received signal characteristic data as a function of a path traveled by a first transmitter unit; transmitting from a second tag transmitter unit transmitting in the vicinity of the path traveled by first receiver unit; comparing received signals from the second transmitter unit to the dataset to evaluate relative proximity of the second transmitter to the first path traveled and location on the first path traveled by the first receiver system.

One embodiment may comprise displaying a graph of the comparison value as a function of path location.

One embodiment may comprise displaying a color bar wherein the color represents the intensity value as a change of color as a function of path location.

A further embodiment may comprise generating an audio signal associated with the second transmitter tag indicative of the comparison value.

One embodiment may include the step of: intercepting the path of the first transmit tag.

The method may further include the step of: detecting a crossing of the path of the first tag by observing a double peak comparison value response as a function of the path variable.

The method may further include the step of: short cutting the path of the first transmit tag by following a later peak response of a double peak comparison response, The method may further include sending multiple rescue tags to look for the path of the firefighter needing rescue.

The method may further include determining said comparison data set using an error vector calculation.

The method may further include wherein the error vector calculation is based on a sequence over a path variable interval of a weighted summation over a set of received signals at a particular path variable value of the squared difference between each corresponding mobile tag signal property measurement and rescue tag signal property measurement.

DETAILED DESCRIPTION OF THE PREFERRED EMBODIMENTS

4.1 Overview of the Invention

Figure 1A:
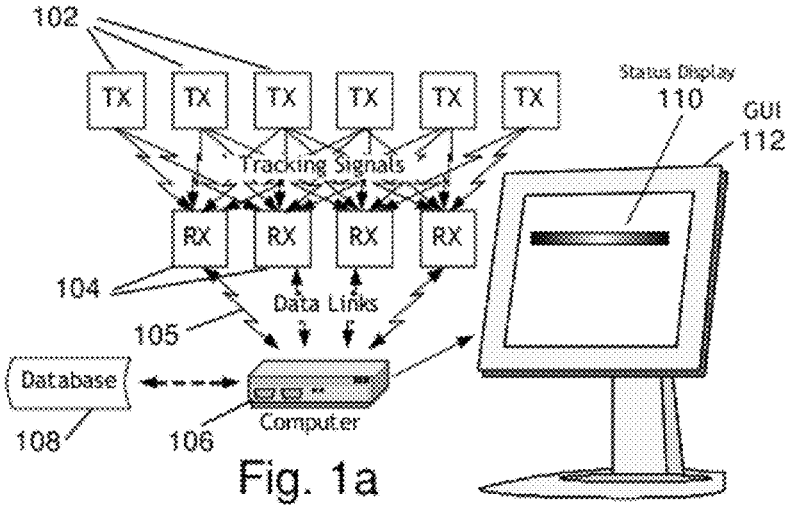
FIG. 1*a* shows a top level block diagram of a first embodiment Firefighter Location and Rescue Equipment.

The present invention is directed toward location equipment particularly useful for firefighter location as a part of a rescue operation. This disclosure will now describe the present invention more fully in detail with respect to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art. Like numbers refer to like elements throughout.

4.2 Near-Field Electromagnetic Ranging

Incumbent prior art location providers typically utilize high frequency, short wavelength wireless systems, like Wi-Fi or UWB, that were optimized for high data rate communications, and they attempt to modify them to solve the challenging problem of indoor wireless location. But location and communication are two fundamentally different problems requiring fundamentally different solutions, particularly in the most challenging RF propagation environments.

Applicants have contributed pioneering work to a novel near field approach to ranging referred to as: "Near-field electromagnetic ranging" (NFER®) technology offers a wireless physical layer optimized for real-time location in the most RF unfriendly settings. NFER® systems exploit near-field behavior within about a half wavelength of a tag transmitter to locate a tag to an accuracy of 1-3 ft, at ranges of 60-200 ft, all at an infrastructure cost of $0.50/sqft or less for most installations. NFER® systems operate at low frequencies, typically around 1 MHz, and long wavelengths, typically around 300 m. FCC Part 15 compliant, low-power, low frequency tags provide a relatively simple approach to wireless location that is simply better in difficult environments.

Low frequency signals penetrate better and diffract or bend around the human body and other obstructions. This physics gives NFER® systems long range. There is more signal structure available in the near field than in the far field. Radial field components provide the near field with an extra (third) polarization, and the electric and magnetic field components are not synchronized as they are for far-field signals. Thus, the near field offers more trackable parameters. Also, low-frequency, long-wavelength signals are resistant to multipath. This physics gives NFER® systems high accuracy. Low frequency hardware is less expensive, and less of it is needed because of the long range. This makes NFER® systems more economical in more difficult RF environments.

Near field electromagnetic ranging was first fully described in "System and method for near-field electromagnetic ranging" (Ser. No. 10/355,612, filed Jan. 31, 2003, now U.S. Pat. No. 6,963,301, issued Nov. 8, 2005). This application is incorporated in entirety by reference. Some of the fundamental physics underlying near field electromagnetic ranging was discovered by Hertz [Heinrich Hertz, Electric Waves, London: Macmillan and Company, 1893, p. 152]. Hertz noted that the electric and magnetic fields around a small antenna start 90 degrees out of phase close to the antenna and converge to being in phase by about one-third to one-half of a wavelength. This is one of the fundamental relationships that enable near field electromagnetic ranging. A paper by one of the inventors [H. Schantz, "Near field phase behavior," 2005 IEEE Antennas and Propagation Society International Symposium, Vol. 3A, 3-8 Jul. 2005, pp. 237-240] examines these near-field phase relations in further detail. Link laws obeyed by near-field systems are the subject of another paper [H. Schantz, "Near field propagation law & a novel fundamental limit to antenna gain versus size," 2005 IEEE Antennas and Propagation Society International Symposium, Vol. 3B, 3-8 Jul. 2005, pp. 134-137].

Near-field electromagnetic ranging is particularly well suited for tracking and communications systems in and around standard cargo containers due to the outstanding propagation techniques of near-field signals. This application of NFER® technology is described in "Low frequency asset tag tracking system and method," (Ser. No. 11/215,699, filed Aug. 30, 2005, now U.S. Pat. No. 7,414,571, issued Aug. 19, 2008). Near-field electromagnetic ranging works well in the complicated propagation environments of nuclear facilities and warehouses. An NFER® system provides the real-time location system in a preferred embodiment of co-pending "System and method for simulated dosimetry using a real-time location system" (Ser. No. 11/897,100, filed Aug. 29, 2007). An NFER® system also provides the real-time location system in a preferred embodiment of co-pending "Asset localization, identification, and movement system and method" (Ser. No. 11/890,350, filed Aug. 6, 2007). All of the above listed US patent and patent applications are hereby incorporated herein by reference in their entirety.

In addition, AM broadcast band signals may be characterized by "near field" behavior, even many wavelengths away from the transmission tower. These localized near-field signal characteristics provide the basis for a "Method and apparatus for determining location using signals-of-opportunity" (Ser. No. 12/796,643, filed Jun. 8, 2010). This US Patent document is hereby incorporated herein by reference in its entirety. The techniques therein disclosed enable an inverse version of the present invention with a mobile tag receiver collecting signal characteristics data and enabling another mobile tag receiver to follow the calibrated path in similar fashion.

Although alternate RF signaling techniques may be of value in conjunction with FLARE, Applicants have discovered that near-field electromagnetic ranging concepts and techniques help enable a particularly effective implementation of FLARE.

4.3 The Preferred Embodiment System

FIG. 1*a* shows an exemplary top level system block diagram of Firefighter Location and Rescue Equipment. A plurality of Tag Transmitters 102 each emit tracking signals that are received by a plurality of Locator Receivers 104. Each tag transmitter 102 may be carried by a different individual fire fighter. A plurality of locator receivers 104 are located in the vicinity of the firefighting operations, typically outside the building. The locator receivers measure signal characteristics and relay data pertinent to signal characteristics via a data link 105 to a central computer 106. In a preferred embodiment data links 105 are conveyed over a wireless network.

A central computer stores signal characteristic data from the multiple receivers 104, correlated with the time stamp and with a particular Tag Transmitter 102 in a database 108. Alternatively, or in addition, the database may include any distance, direction or other information available from the transmitter tag. If it becomes necessary to conduct a rescue operation, the computer can compare live, real-time signal characteristic data from a rescuer's Tag Transmitter to that stored in the database for the firefighter requiring assistance. The rescuers tag transmitter should preferably have nearly the same frequency and/or amplitude and have nearly the same type of antenna and other characteristics as necessary to assure at least a known relationship and preferably nearly the identical signal characteristics as the first tag transmitter when transmitting from the same location. Typically the rescue tag transmitter is of the same design as the first transmitter. The comparison information may be displayed as a status display in text or graphics, preferably using a graphical status display 110 as part of a graphics user interface (GUI) 112. By correlating the live signal characteristic data from a rescuer's Tag to the time history of the signal characteristic data from the Tag of the firefighter requiring assistance, FLARE can determine if the rescuer is on the path taken by the firefighter requiring assistance and if so, where. If the firefighter requiring assistance has doubled back and crossed his own path, it is possible for the rescuer to bypass the intermediate path and proceed more directly along the appropriate path to the firefighter requiring assistance.

In effect, FLARE records signal characteristic data representative of the particular path taken by a Tag, so as to enable rescuers to follow the same path to find the lost firefighter.

Complicated propagation environments do tend to perturb the near-field phase relations NFER® systems rely upon. This problem may be overcome by using calibration methods described in "Near-field electromagnetic positioning system and method" (Ser. No. 10/958,165, filed Oct. 4, 2004, now U.S. Pat. No. 7,298,314, issued Nov. 20, 2007). Additional calibration details are provided in "Near-field electromagnetic positioning calibration system and method" (Ser. No. 11/968,319, filed Nov. 19, 2007, now U.S. Pat. No. 7,592,949, issued Sep. 22, 2009). Still further details of this calibration are provided in co-pending "Near-field electromagnetic positioning calibration system and method" (Ser. No. 12/563,960, filed Sep. 21, 2009. These applications are incorporated herein by reference in their entirety.

Figure 1B:
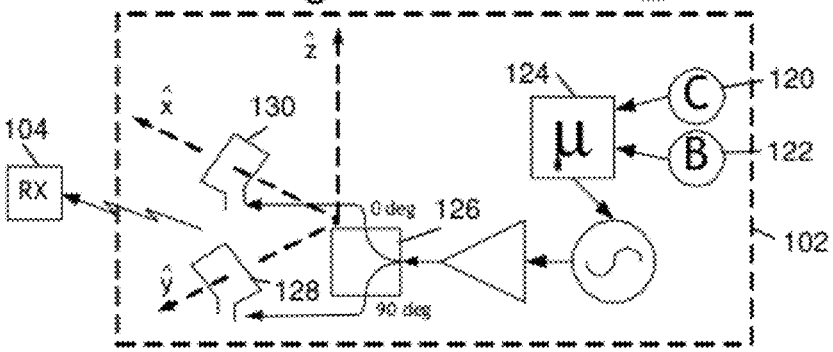
FIG. 1*b* shows a block diagram of a Tag Transmitter Module for use in a Firefighter Location and Rescue Equipment system.

FIG. 1*b* shows an exemplary block diagram of a Tag Transmitter 102 for use in a Firefighter Location and Rescue Equipment system. In a preferred embodiment, a Tag Transmitter 102 employs at least two quadrature fed orthogonal magnetic antennas 128, 130 so as to emit a quasi-isotropic signal. A microprocessor 124 may impose a modulation on an oscillator that feeds a power amplifier. In one embodiment, a quadrature splitter 126 generates the quadrature signals that feed at least two orthogonal magnetic antennas 128, 130. A microprocessor 124 may receive data from any number of sensors 120, 122 and transmit that data to be recorded with the signal data. The sensors include, but are not limited to: a magnetic compass 120 (C) to aid in establishing bearing, a barometer 122 to evaluate altitude from a pressure measurement, or from both. The sensors may further include inertial sensors, accelerometers, gyros, pedometers, or other sensors. Accelerometers may also aid in determining firefighter orientation and movement and may enable a microprocessor to modulate an emergency signal if the firefighter is down and/or stationary. The proposed system may be advantageously deployed in conjunction with additional sensors for evaluating the health and well-being of the user, and to characterize the environment within which the user operates.

Applicants have found that orthogonal magnetic antennas offer unique advantages for transmission and reception in real-time location systems. Details may be found in "Near-field location system and method," (Ser. No. 11/272,533, filed Nov. 10, 2005, now U.S. Pat. No. 7,307,595, issued Dec. 11, 2007). Additional compact antenna designs are shown in co-pending "Space efficient magnetic antenna system," (Ser. No. 11/473,595, filed Jun. 22, 2006, now U.S. Pat. No. 7,755,552). Further, the phase properties of near-field signals from orthogonal magnetic and other multiple antenna near-field transmission signals enable additional phase comparison states that can be used for location and communication, as described in co-pending "Multi-state near-field electromagnetic system and method for communication and location," (Ser. No. 12/391,209, filed Feb. 23, 2009. These applications are incorporated in entirety by reference.

Figure 1C:
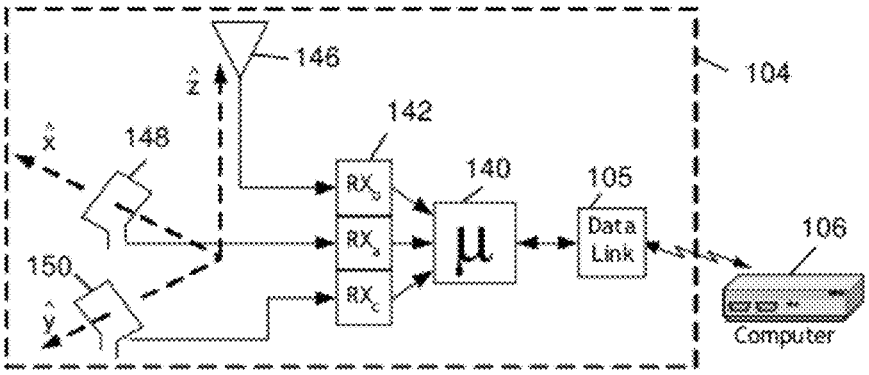
FIG. 1*c* shows a block diagram of a Locator Receiver for use in a Firefighter Location and Rescue Equipment system.

FIG. 1*c* shows an exemplary block diagram of a Locator Receiver for use in a Firefighter Location and Rescue Equipment system. In a preferred embodiment, a Locator Receiver 104 is a three channel receiver 142, employing two orthogonal loop (magnetic) antennas 148, 150 and a vertical whip (electric) antenna 146. In alternate embodiments, additional data may be obtained by capturing and evaluating all three orthogonal electric field signal components and all three orthogonal magnetic field components. In still further embodiments a FLARE may employ some alternate subset of signal components.

In a preferred embodiment, a FLARE Locator Receiver may employ signal characteristics including comparisons between signal characteristics, e.g., a comparison between electric and magnetic phase, a comparison between the magnetic phase received at each of two orthogonal antennas or other phase or amplitude comparisons.

Microprocessor 140 processes signals from the multi channel receiver 142, determines comparisons, detects sensor data (see FIG. 1*b*, 120, 122), and formats data for the data link 105 to the computer 106. Alternatively, one or more processing functions may be performed by the computer 106 instead of the microprocessor 140. Other computation architectures may be designed by those skilled in the art.

In an alternative embodiment, the FLARE system may be based on a receiver tag module operating with a set of transmitters. The transmitters are set up to provide a field of multiple signals, each potentially having multiple properties to be measured. Signals-of-opportunity may be employed to provide suitable transmit signals according to the teachings of the present invention. The receiver tag module receives each transmission separately and measures each property of each signal and records the properties in a database along with by time or distance or other path variable. The transmitters may be separated by frequency division, time division or both. Other multiple access methods may be used. The database may be on the tag or at a central computer in the relative safety of the perimeter of the scene. The receiver tag is capable of transmitting the database information to a central computer or to a rescue receiver.

A rescue receiver receives the same transmitter signals and measures the current properties and receives the database information from the first tag (down tag needing rescue). The rescue receiver compares the currently received signal properties with the historical database of down tag received properties and generates a display of the results. The display may be a color or graph display of comparison value vs. a path variable, such as, for example, time or distance traveled along a path.

Figure 1D:
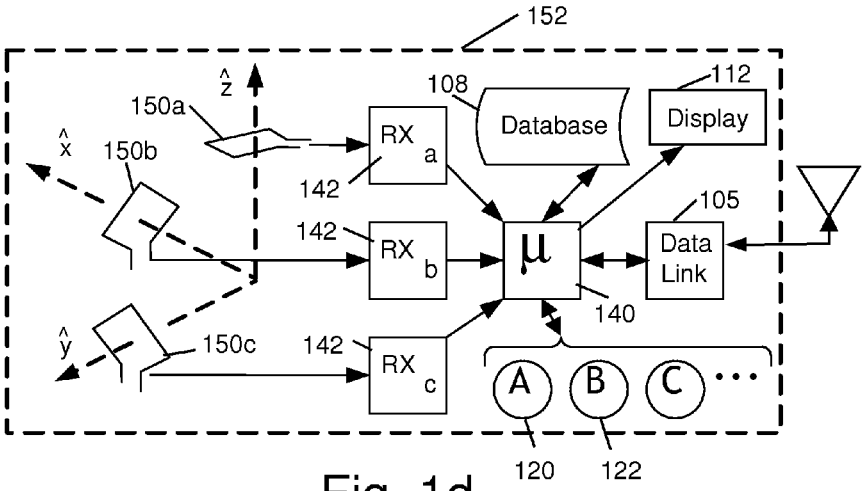
FIG. 1*d* shows a block diagram of a Receiver Tag Module for use in a Firefighter Location and Rescue Equipment system.

FIG. 1*d* shows a block diagram of a Receiver Tag Module for use in a Firefighter Location and Rescue Equipment system. The receiver tag module 142 may include one or more receivers 142 connected to one or more antennas 150*a*, 150*b*, and 150*c* and measuring one or more signal properties. The three antennas 150*a*, 150*b*, and 150*c* are positioned orthogonal to allow signal evaluation for any orientation of the receiver. The three received signals may be processed as a vector combination of the three received signals to obtain an orientation independent evaluation of the signal. The receiver tag may be used in data collection mode by a firefighter or in a data comparison mode by a rescuer or in both modes at the same time. The signal properties are provided to the microprocessor 140, which controls tag operation. The received properties are stored in a database 108 and/or transmitted to a central station via a data link 105 and data antenna. The signal properties are stored along with path information, for example time or distance traveled. In addition, sensor values 120, 122, for example gravity/motion sensing (accelerometer—A), altitude/pressure sensing (barometer—B), magnetic orientation (compass—C), motion sensing, temperature, altitude or other parameters may also be stored in the database. The receiver may include an optional display or audio interface to convey data to a user. In one embodiment, the display 112 may be separate and may be mounted with or on the firefighter helmet. The display may be, for example, a heads up type display. The display may be coupled using a cable or wirelessly by, for example, a Bluetooth link. The display is valuable for use as a rescuer receiver tag. In rescuer mode, the receiver tag receives current live signals and receives historical path data for the firefighter to be rescued via the data link 105. The historical path data may pertain to another user (such as a firefighter to be rescued), or may be historical path data gathered by the Receiver Tag Module enabling self-guidance out along the user's entry path. The microprocessor generates comparison values and displays the comparison on the display. The microprocessor may also display associated orientation, altitude and or other historical information stored by the firefighter.

Figure 1E:
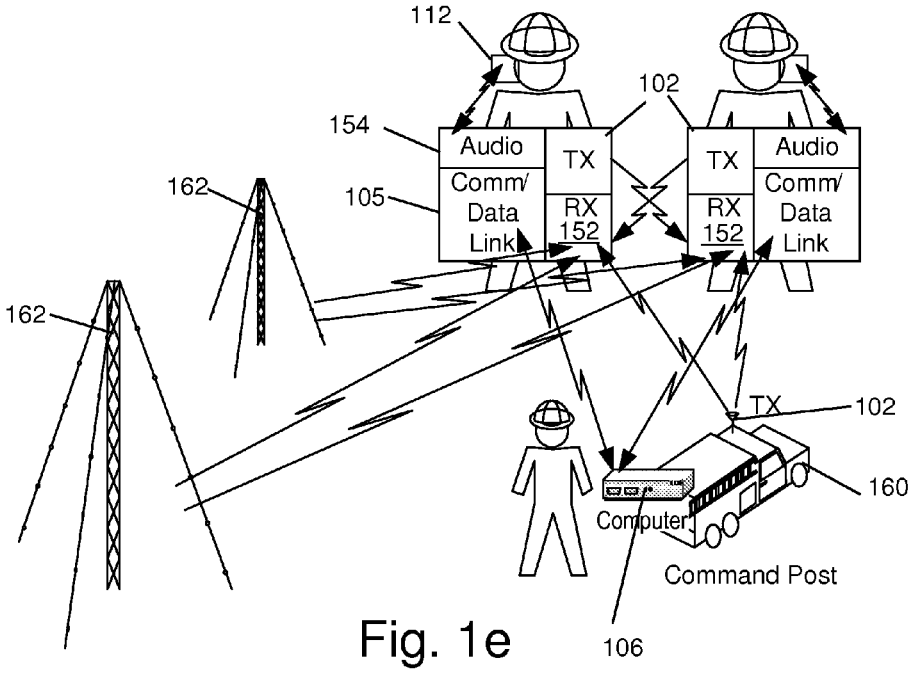
FIG. 1*e* shows a top level block diagram of a second (preferred) embodiment Firefighter Location and Rescue Equipment system.

FIG. 1*e* shows a top level block diagram of an exemplary second (preferred) embodiment Firefighter Location and Rescue Equipment system. The diagram of FIG. 1*e* shows two tag systems carried by two firefighters. The two tag systems are in communication with one another and with a command post 160. The two tag systems may also receive signals from a signal of opportunity transmitter, such as for example, one or more AM broadcast band transmitters 162. In a preferred embodiment system, a preferred embodiment FLARE tag comprises a transmit tag module 102, like that of FIG. 1*b*, a receive tag module 152, like that of FIG. 1*d*, an audio interface 154, and a communications/data link 156. The functionality of a FLARE tag may be incorporated in a single device or distributed among a variety of distinctly packaged devices. In particular, a FLARE tag may take advantage of an existing two-way radio device to provide a communications/data link 105 as well as an audio interface 154.

By combining a receive tag module with a transmit tag module, a preferred embodiment FLARE tag enables local situational awareness between users in a particular area. A receiver tag module can monitor transmitter tag modules of other nearby users, thus enabling a proximity detection capability. This proximity detection capability can provide notice if another user has become separated from a team, or enable homing in on a sought for user who requires rescue.

An audio interface may provide a variety of audio cues to a user to enhance the user's situational awareness. The audio interface should be implemented so as not to interfere with voice communications, in particular with communications from or to the incident commander. The audio interface may provide a periodic chirp modulated in amplitude or frequency so as to provide a firefighter with path comparison information. The audio interface thus enables guidance of progress or location along a calibrated path—either a user's own path, a path of another user requiring rescue, or yet another path that could help guide a user to a desired destination. Additional audio cues may provide an indication that a colleague or team member has become separated from the group or that a user is coming in close proximity to a sought team member.

Nothing in this enclosure should be construed as requiring only a receiver tag or only a transmitter tag. As exemplified by the present disclosure, one or more elements of both implementations can work together to yield synergies unavailable to either alone.

Figure 2A:
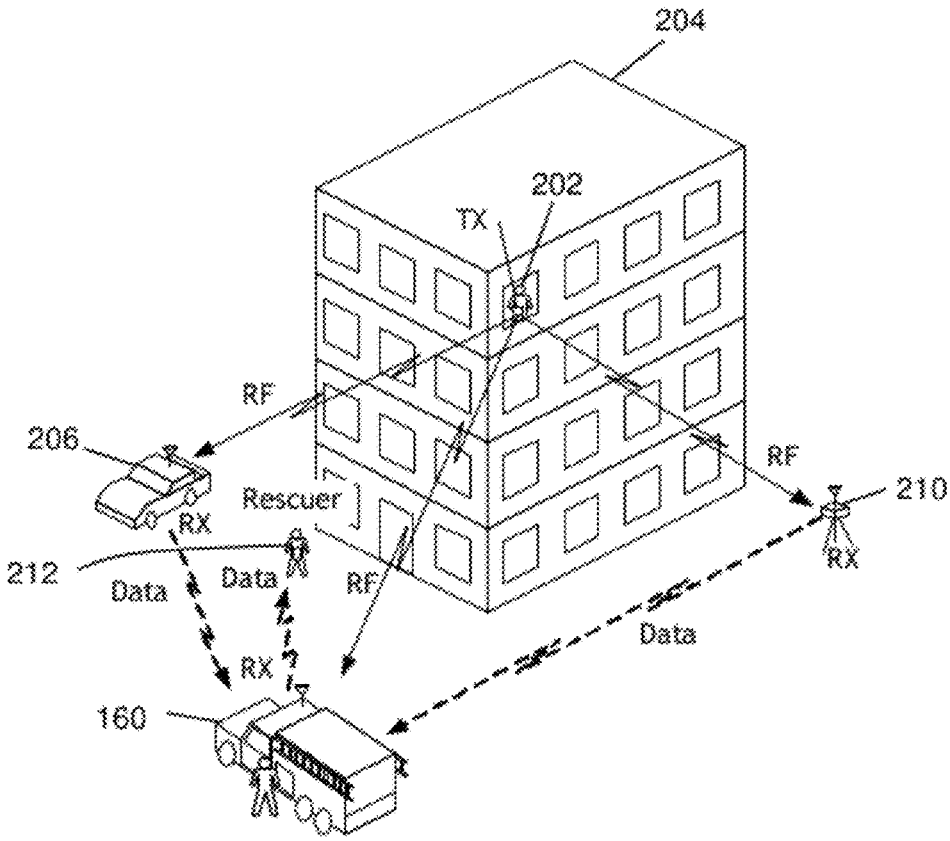
FIG. 2*a* shows a sketch of an operational deployment of a first embodiment Firefighter Location and Rescue Equipment system.

FIG. 2*a* shows an exemplary sketch of an operational deployment of a first embodiment Firefighter Location and Rescue Equipment system. FIG. 2*a* shows a first transmitter 202 carried by a firefighter in the fourth floor of the building 204 and a second transmitter 212 with a rescuer about to enter the building. The second transmitter unit is also configured to receive command signals and/or path comparison information from the computer in the command vehicle 208. Three receivers, positioned at 206, 208, and 210, are positioned around the building to observe the transmitter 202 from different viewpoints and propagation paths through the building 204 so that the signal characteristics will more likely vary differently from one another for different locations of transmitter 202 within the building 204. A FLARE Locator Receiver may be readily mounted in a fire truck or other vehicle. Additional FLARE Locator Receivers may be deployed around or even within a building at an emergency response scene. Additional FLARE Locator Receivers may be deployed as an emergency unfolds, either in a building or around the emergency incident scene. A FLARE Tag Transmitter 202 emits an RF signal that is received by a plurality of FLARE Locator Receivers 206, 208, 210. Each FLARE Locator Receiver relays data pertinent to signal characteristics via a data link to a central computer at location 208. The central computer stores time correlated (i.e., time stamped) signal characteristics data for each tag. If a rescue becomes necessary, live signal characteristic data from a rescuer's Tag Transmitter 212 may be correlated to the stored data for the Tag Transmitter 202 that was carried by the firefighter requiring assistance. In one embodiment the correlated data may be available and displayed at the central computer location 208 and an incident commander or other supervisor can observe the display and provide vector directions to a rescuer 212 to enable the rescuer to travel along the path taken by a firefighter requiring assistance. In further embodiments, the rescuer's tag transmitter 212 may also include a receiver for receiving the comparison data that may be displayed in real time to the rescuer. In a further embodiment, the rescuer receiver 212 might employ a heads-up display or LED array to display FLARE guidance visually, or may use acoustic cues to guide the rescuer.

Figure 2B:
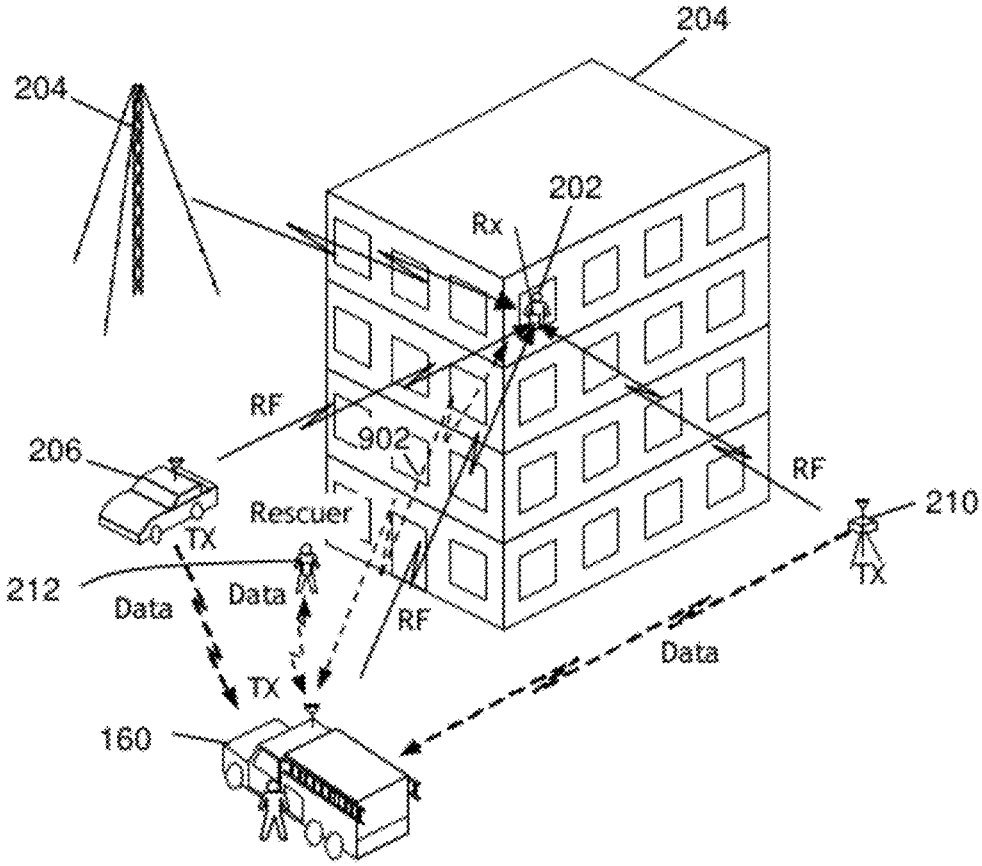
FIG. 2*b* shows a sketch of an operational deployment of a second embodiment Firefighter Location and Rescue Equipment system.

FIG. 2*b* shows a sketch of an operational deployment of a second embodiment Firefighter Location and Rescue Equipment system utilizing the receiver tag of FIG. 1*e*. FIG. 2*b* is analogous to FIG. 2*a* in the positions of the equipment and rescue operations. FIG. 2*b* differs in that the transmitter tag of FIG. 2*a* is now a receiver tag and the signal characterization receivers of FIG. 2*a* are now signal transmitters, supplementing signals-of-opportunity available from AM broadcast stations or other sources. Also shown is a two way data link between the receiver tag at the firefighter 202 and the control station 208. At least one way is needed for the data link 902, however, digital data links are usually two way for error detection and correction and security protocols. A two way data link is also shown between the rescuer receiver tag and the control station. The rescuer receives historical database data from the command center. A two way data link may be preferred for protocol reasons. Alternatively, (not shown), the rescuer 212 may receive historical database data directly from the firefighter tag at 202. Also, a firefighter 202 may use historical data stored locally in the receiver tag for self-guidance.

Details of particular operational deployments will necessarily vary depending on the context and nature of the deployment. The description herein is for purpose of illustration and should not be interpreted as limiting FLARE to a particular deployed configuration.

4.4 The Preferred Embodiment Process

Figure 3A:
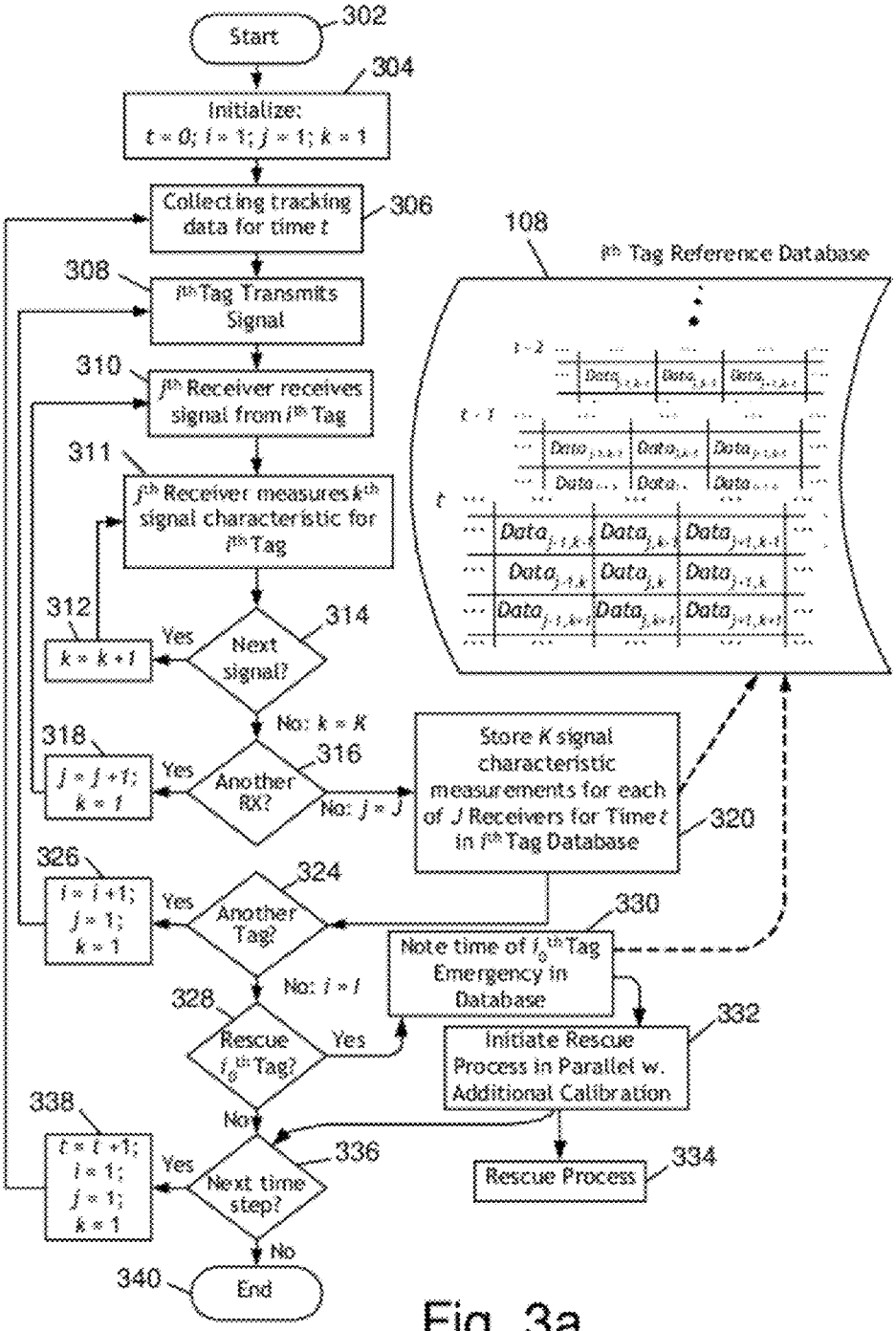
FIG. 3*a* presents a process flow diagram of a path recording process for a first embodiment Firefighter Location and Rescue Equipment system.

FIG. 3*a* presents a first embodiment process flow diagram of a path recording process for a Firefighter Location and Rescue Equipment system. The process of FIG. 3*a* involves an external network of fixed receivers recording signal characteristics from mobile transmitters at an incident scene. The FLARE path recording process collects K signal characteristics from each of J receivers, for each of I tags, at each time step t. Additional FLARE Locator Receivers may be added to the J receivers, thus increasing J over the course of an incident. A computer accumulates a reference database with a J×K matrix of signal characteristics for each of I tags, at each time step (or interval) t. The reference data base continues to grow over the course of an emergency incident. If a rescue of a firefighter carrying the $i_0^{th}$ Tag Transmitter becomes necessary, a rescue process may be initiated in parallel with a continuing path recording process.

One of ordinary skill will realize that the order or nesting of the various process loops may be different in equivalent implementations of the present invention.

The process of FIG. 3*a* starts 302 by initializing the database indices, i, j, k, at 304. Steps 306, 308, 310 and 311 perform associated functions for the associated parameters. One of ordinary skill may observe that a number of transmitters, receivers, and measurements may operate in parallel, at varying rates, or in different orders. The exemplary indexing is for illustration purposes. Similarly, blocks 314, 316, 324, and 336 examine index range for cycling through each index and blocks 312, 318, 326 and 338 increment each associated index. When operations are complete, the process is ended 340. Step 320 stores data the database 108 for each receiver, when a complete set of receivers is measured and stored for a given tag, another tag is measured. Multiple transmit tag modules may be multiplexed using various methods known in the art. Convenient methods include frequency, time, and/or code division methods.

Step 328 determines the need for rescue associated with one of the tags. Rescue can be initiated by a firefighter through the tag. The firefighter may press a button on the tag or vital sign monitors within the tag may trigger an alarm condition. Alternatively or in combination vertical orientation sensors or motion sensors may detect abnormal orientation or inactivity and trigger an alarm condition. The firefighter may call on a voice radio or other firefighters or officers may observe or otherwise detect trouble and call for rescue that is then initiated at the control center. The emergency is noted in the database 330 and the emergency rescue operation mode is initiated 332 and rescue process started 334.

Figure 3B:
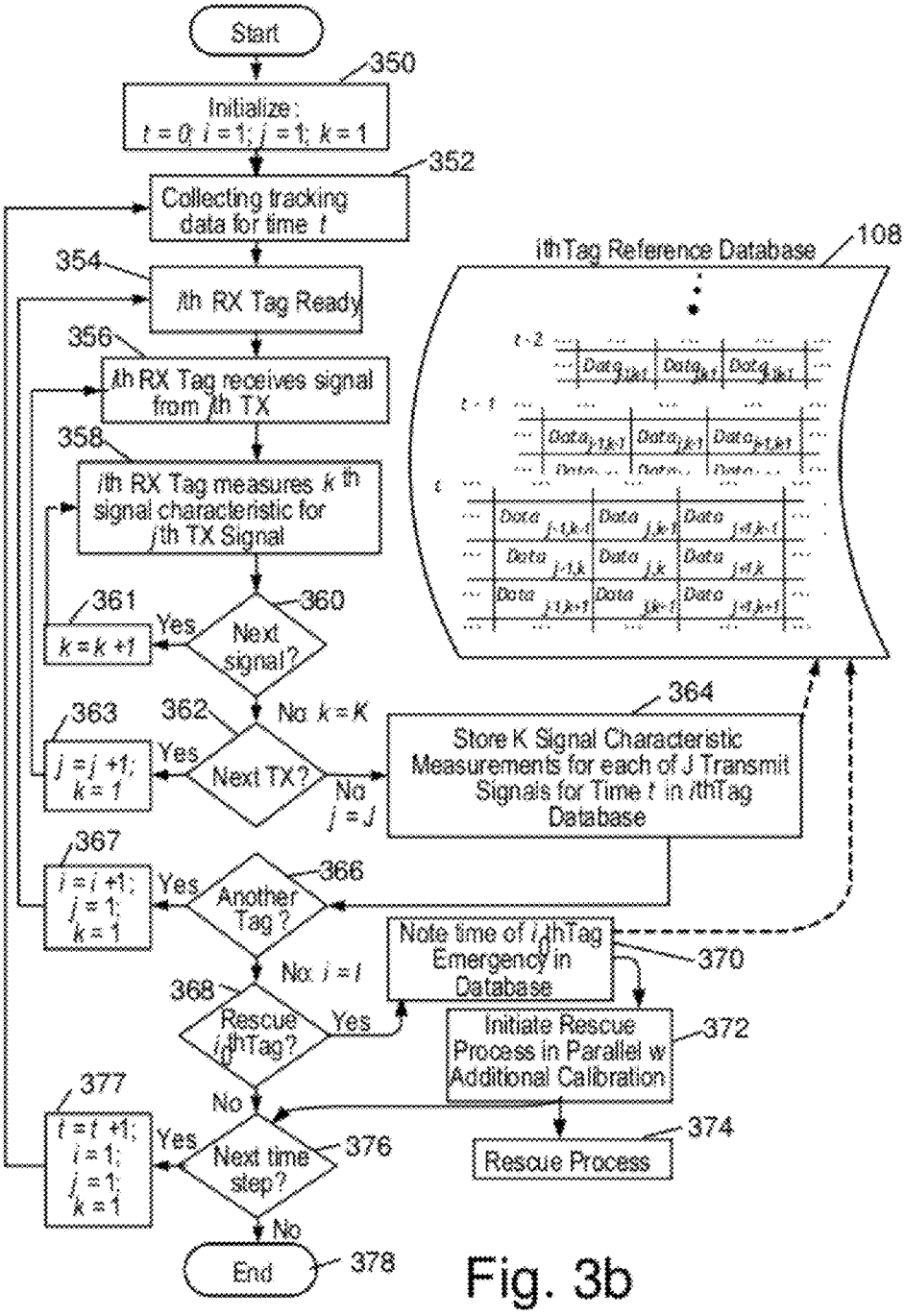
FIG. 3*b* presents a process flow diagram of a path recording process for a second embodiment Firefighter Location and Rescue Equipment system.

FIG. 3*b* presents a second embodiment process flow diagram of a path recording process for a Firefighter Location and Rescue Equipment system. The process of FIG. 3*b* involves mobile receiver tags recording signal characteristics from fixed transmitters and/or signals-of-opportunity at an incident scene. FIG. 3*b* is analogous to FIG. 3*a* except that index j refers to the $j^{th}$ of J transmit signals, instead of the $j^{th}$ of J receivers. Also, in the second embodiment path recording process, the $i^{th}$ Tag Reference Database may be compiled at a central server, stored locally in a particular receive tag, or exchanged between users in a group.

Because each receive tag may potentially have a local copy of its own reference database, rescue process 334 can be initiated locally, without need to query or receive data from a remote server or from a different receiver tag. Rescue process 334 can be a self-rescue process, providing a user self-guidance and navigation capability that will be helpful not only in rescue situations, but also in typical incident response site operations. In still further embodiments, a rescue process may be triggered locally as a receive tag module detects that contact with a team member has been lost.

The process of FIG. 3*b* starts by initializing the database indices, i, j, k, at 350. Steps 352, 354, 356 and 358 perform associated functions for the associated parameters. One of ordinary skill may observe that a number of transmitters, receivers, and measurements may operate in parallel, at varying rates, or in different orders. The exemplary indexing is for illustration purposes. Similarly, blocks 360, 362, 366, and 376 examine index range for cycling through each index and blocks 361, 363, 367, and 377 increment each associated index. When operations are complete, the process is ended 378. Step 364 stores data the database 108 for each transmit signal. Multiple transmitters may be multiplexed using various methods known in the art. Convenient methods include frequency, time, and/or code division methods.

Step 368 determines the need for rescue associated with one of the tags. Rescue can be initiated by a firefighter through the tag. The firefighter may press a button on the tag or vital sign monitors within the tag may trigger an alarm condition. Alternatively or in combination vertical orientation sensors or motion sensors may detect abnormal orientation or inactivity and trigger an alarm condition. The firefighter may call on a voice radio or other firefighters or officers may observe or otherwise detect trouble and call for rescue that is then initiated at the control center. The emergency is noted in the database 370 and the emergency rescue operation mode is initiated 372 and rescue process started 374.

Figure 3C:
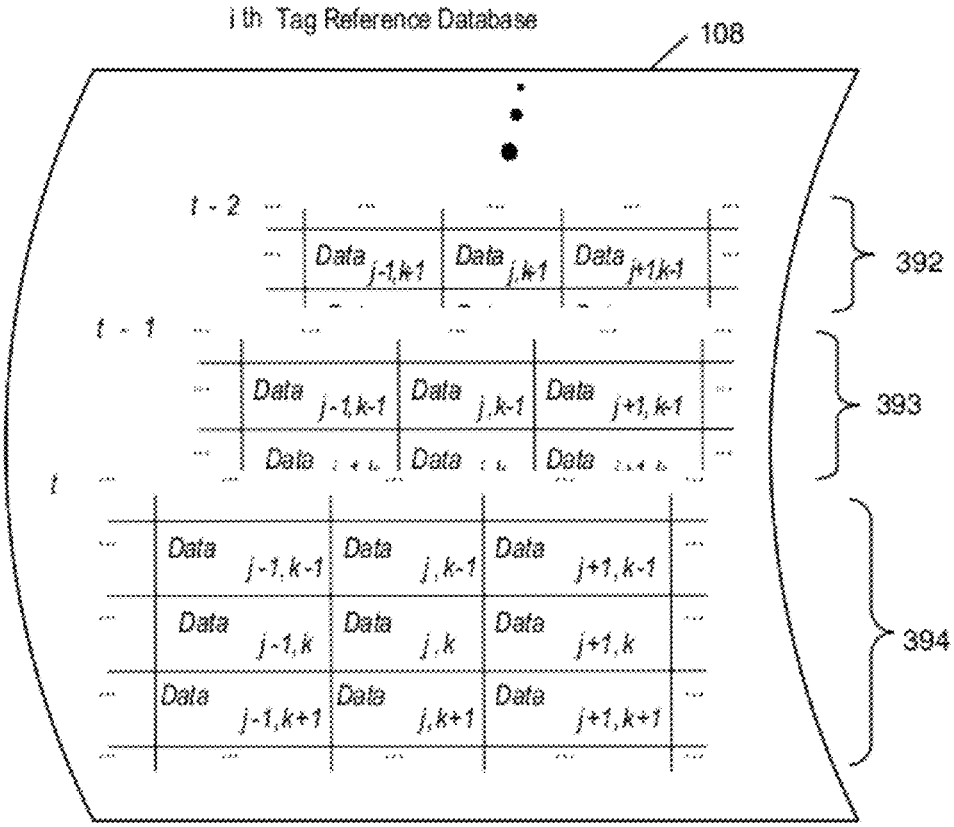
FIG. 3*c* represents an exemplary tag reference database.

FIG. 3*c* represents an exemplary tag reference database. FIG. 3*c* represents a database organized for storing data relating to the $i^{th}$ tag. For each time step t, data is stored relating to K received signal characteristics collected for each of J receivers (or J transmitters), depending on the embodiment (FIG. 3*a* or FIG. 3*b*) as previously discussed.

Figure 4A:
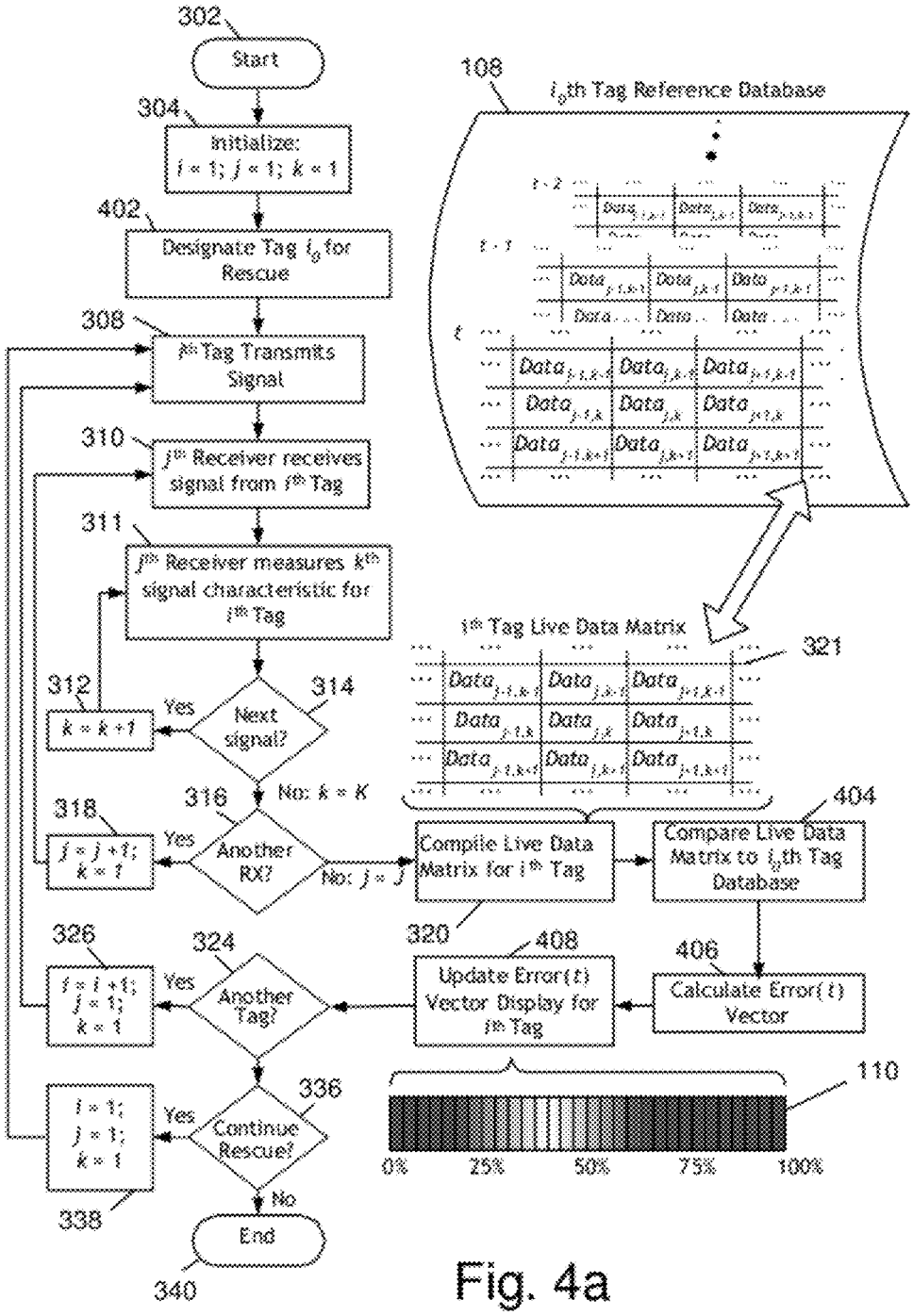
FIG. 4*a* presents a process flow diagram of a rescue process for a first embodiment Firefighter Location and Rescue Equipment system.

FIG. 4*a* presents an exemplary process flow diagram of a first embodiment rescue process for a Firefighter Location and Rescue Equipment system. The process of FIG. 4*a* involves an external network of fixed receivers recording signal characteristics from mobile transmitters at an incident scene and comparing them to signal characteristics in a reference data set so as to provide path guidance. A FLARE rescue process is analogous to a FLARE path recording process in that K signal characteristics are collected from J Locator Receivers for one (or more) rescue tags so as to yield a Live Data Matrix. The Live Data Matrix is then compared to each time step worth of data in the $i_0^{th}$ Tag Reference Database. One comparison that has proven effective is to calculate the error vector (Error(t)) between the Live Data Matrix and the $i_0^{th}$ Tag Reference Database for each time step "t:"

$$\text{Error}(t) = \sqrt{\sum_{j=0}^{J}\sum_{k=0}^{K} C_k(\text{Live}_{j,k} - i_0^{th}RefData(t)_{j,k})^2} \qquad \text{Equation 1}$$

where $C_k$ is a constant enabling scaling or weighting of the $k^{th}$ signal characteristic;

$\text{Live}_{J,k}$ is the rescue tag signal measurements at the current time;

$i_0^{th}$ $\text{RefData}(t)_{j,k}$ is the historical recorded set of signal measurements of the mobile tag of the firefighter needing rescue ($i_0^{th}$ tag) t) that were recorded at time step t;

k is the index for K signal characteristics; and j is the index for J fixed units (in this case receivers, alternatively, with a mobile receiver tag, the fixed units may be transmitters).

$C_k$ is a set of K weighting factors to optimize the result and may also include units conversion, thus allowing the combination of signal amplitude measurements with phase difference measurements in the total error result. In one embodiment, the amplitude measurements are in a logarithmic scale (dB). In another embodiment, the amplitude measurements are in linear voltage scale or alternatively a linear power scale. Typically amplitude and phase shift error signals are scaled by $C_k$ so that the amplitude error values have approximately the same magnitude of effect as the phase error values when averaged over the range of a typical scenario. $C_k$ is typically established based on system testing and then fixed for the duration of an operation.

The error vector is a one dimensional array (alternatively referred to as a sequence) of error( ) values evaluated by comparing the current rescuer tag signal property measurements with the database of mobile tag measurements over a range of the path variable (typically time). Thus, the error vector calculation is based on a sequence over a path variable interval of a weighted summation over a set of received signals at a particular path variable value of the squared difference between each corresponding historical mobile tag signal property measurement and the current rescue tag signal property measurement. Other mathematical comparisons or correlation between live and reference data may be advantageously employed. This error vector may be used to generate a status display. The inventors have found that one particularly effective way to display the error vector is in a one-dimensional bar whose color or intensity represents the magnitude of the error and whose length corresponds to the parametric length (as measured by elapsed time) of the path taken by the firefighter in distress. Other path variables, for example distance traveled, may be used when the system includes sensors for measuring the path variable. For example, distance traveled may be measured by, for example but not limited to, a pedometer or inertial sensors.

In alternate embodiments, the error vector may be plotted in a 2-D graph with time step on one axis and error magnitude on the other. In still further embodiments, a wide variety of potential graphical display methods are known to those of ordinary skill in the art.

Referring to FIG. 4*a*, the recording process continues for each of the tags. The indices continue to be incremented, measurements taken and recorded in the database; however, one of the tags is designated for rescue 402. New data continues to be recorded from all tags including from the for-rescue tag 202.

Any tag can rescue. Any tag can cross the path of the down tag. Typically, a designated rescuer or rescue team may track and locate the down tag. Referring, again to FIG. 4*a*, a rescuer is sent to locate the down tag. The rescuer tag 212 signal 321 is compared with the down tag signal database 404, and an error vector is calculated 406. The comparison is displayed for interpretation 408. In one embodiment, a color bar is displayed 110.

The exemplary color bar 110 of FIG. 4*a* shows a linear (rectangular) bar preferably disposed horizontally to a viewer, with the longer dimension placed horizontally. The long axis of the bar represents the path taken by the tag. The path dimension may be related to distance or time or other path variable. Time is a low cost and easily implemented variable. With distance measuring sensors, distance can be used as a long axis variable. The short axis is typically uniformly colored by the color corresponding to the comparison value of the present rescuer tag signal with the historical down tag according to the time represented by that short axis stripe. The color represented may be any desired color scheme. Color in this context may include gray scale. In one embodiment, the color is a monotonically increasing brightness for values of comparison from zero to a predetermined maximum value. In another embodiment, the color is a monotonically increasing percentage of a first color relative to a second color as a function of the comparison value from zero to a predetermined maximum value. Further embodiments cycle through additional multiple colors.

The color bar is shown as a relatively smooth function with a single maximum. In practice, the function is more likely to include noise like variations due to the fine structure of the environment.

Figure 7A:
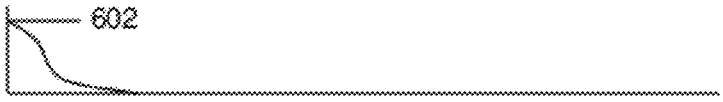
FIG. 7*a*-FIG. 7*k* illustrate the comparison sets described and shown with FIGS. 6*a*-6*k* except that FIGS. 7*a*-7*k* utilize an alternative graphical display
Figure 7B:
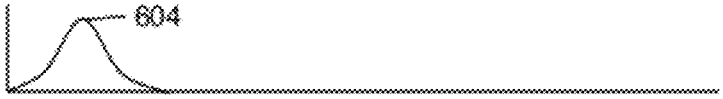
Figure 7C:
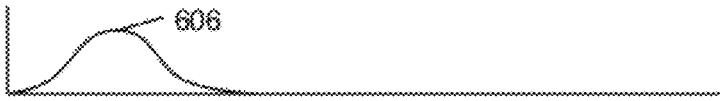
Figure 7D:
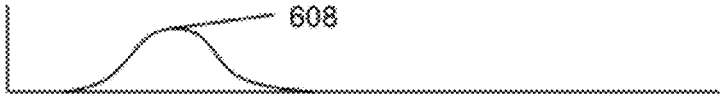
Figure 7E:
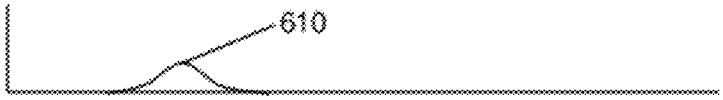
Figure 7F:
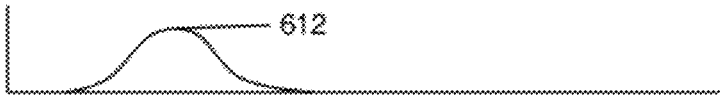
Figure 7G:
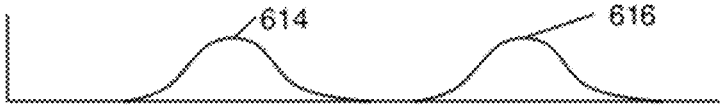
Figure 7H:
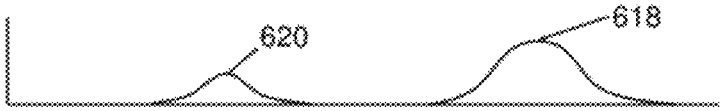
Figure 7I:
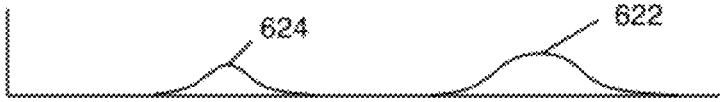
Figure 7J:
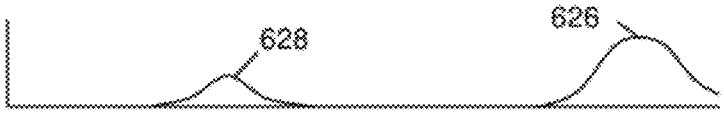
Figure 7K:
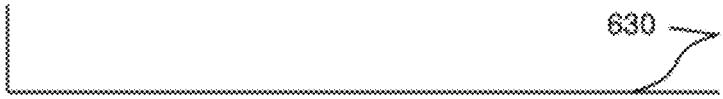
Figure 8:
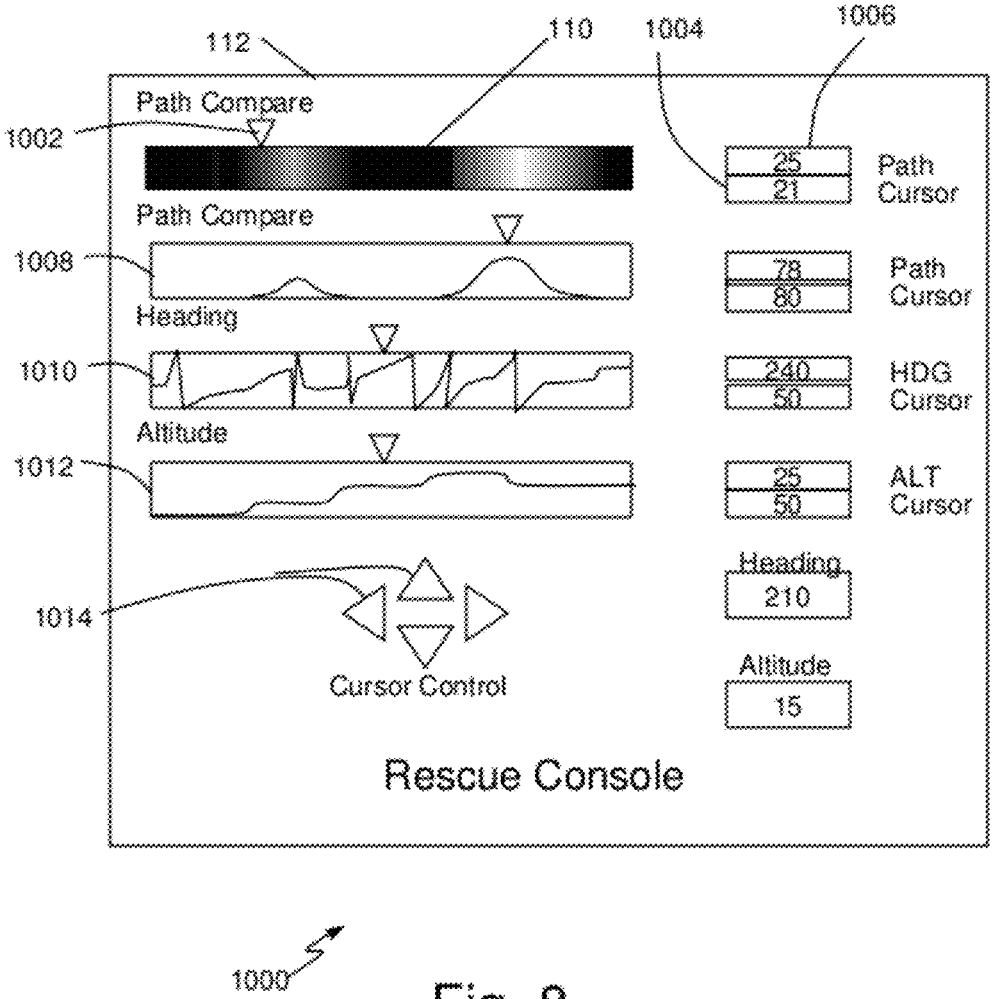
FIG. 8 illustrates an exemplary rescuer display for use in association with a transmit tag or receiver tag system embodiment.

In another embodiment, the display 110 may be a graph (See FIG. 7*a*) showing the comparison value as a function of path.

The color bar 110 of FIG. 10 shows a path scale of zero to 100%. Zero would typically be the path starting point, i.e., the time or place of starting to record path data. The 100% would typically represent the time or place of the firefighter requesting rescue. Alternatively, the recording may continue after rescue is initiated, thus the 100% point is the latest data recorded. The scale may alternatively be marked in time units or distance units or other units as appropriate. A time step for the system may be typically one second, i.e., all tags and all signal properties are sampled at least once per second. The time step may be preferably between 100 milliseconds and ten seconds and may be less than 30 seconds. Subranges of the disclosed ranges are intended to be included.

In one embodiment, the computer may identify one or more peak comparison responses and display the associated path value. In another embodiment, the computer may identify peak responses greater than a predetermined threshold. In a further embodiment, the computer may filter or smooth the comparison data with respect to path value to determine a peak of a smoothed function of comparison data and display the peak value and associated path value.

Figure 4B:
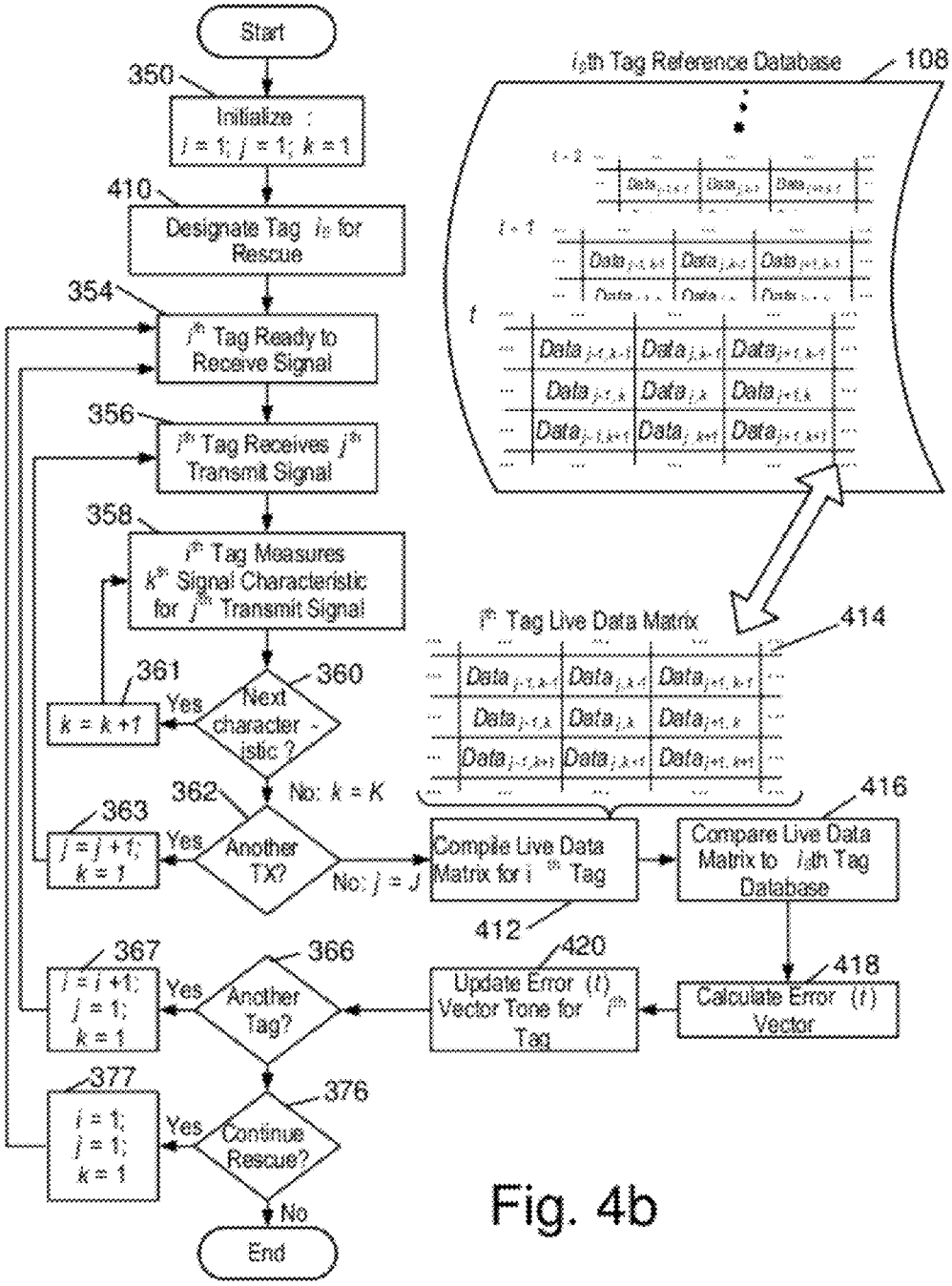
FIG. 4*b* presents a process flow diagram of a rescue process for a second embodiment Firefighter Location and Rescue Equipment system.

FIG. 4*b* presents a process flow diagram of a rescue process for a second embodiment Firefighter Location and Rescue Equipment system. The process of FIG. 4*b* involves mobile receiver tags recording signal characteristics from fixed transmitters and/or signals-of-opportunity at an incident scene so as to provide path guidance. FIG. 4*b* is analogous to FIG. 4*a* except that index j refers to the $j^{th}$ of J transmit signals, instead of the $j^{th}$ of J receivers. Also, in the second embodiment rescue process, the $i^{th}$ Tag Reference Database may be compiled at a central server, stored locally in a particular receive tag, or exchanged between users in a group.

Referring to FIG. 4*b*, the recording process continues for each of the tags. The indices continue to be incremented, measurements taken and recorded in the database; however, one of the tags is designated for rescue 410. New data continues to be recorded from all tags including from the for-rescue tag 202 (FIG. 2*b*).

Any tag can rescue. Any tag can cross the path of the down tag. Typically, a designated rescuer or rescue team may track and locate the down tag. The steps of FIG. 4*b* are similar to FIG. 3*b* and FIG. 4*a*, except where noted. FIG. 4*b* is adapted to utilize the receiver tag embodiment. Referring, again to FIG. 4*b*, a rescuer is sent to locate the down tag. The rescuer tag 212 signal 414 is compared with the down tag signal database 108 in step 416, and an error vector is calculated 418. The comparison is displayed for interpretation 420. In one embodiment an audio tone signal is generated based on the error vector, step 420. Alternatively or in combination, a color bar may be displayed based on the error vector as in FIG. 4A, 110.

4.5 Use in a Hypothetical Rescue Operation

Figure 5A:
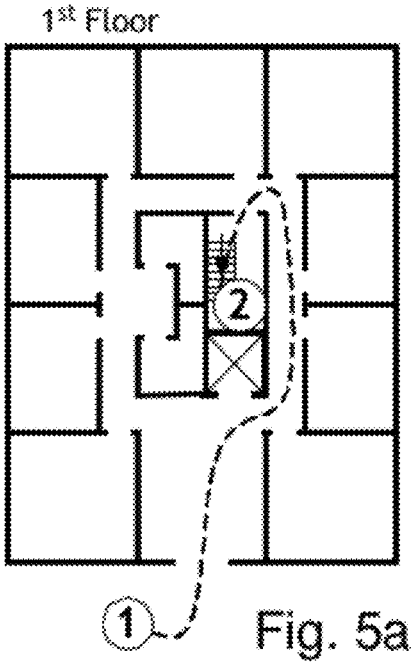
FIG. 5*a* describes first floor action in a hypothetical firefighter rescue operation.

FIGS. 5*a*-5*d*, 6*a*-6*k* and 7*a*-7*k* describe an exemplary firefighter situation where a first firefighter is down and calls for rescue and a rescue firefighter uses the invention to find the first firefighter. FIG. 5*a*-*fd* describe the first path taken by the first firefighter.

In FIG. 5*a* the first firefighter begins at point "1" and traverses the first floor to the stairwell at point "2."

Figure 5B:
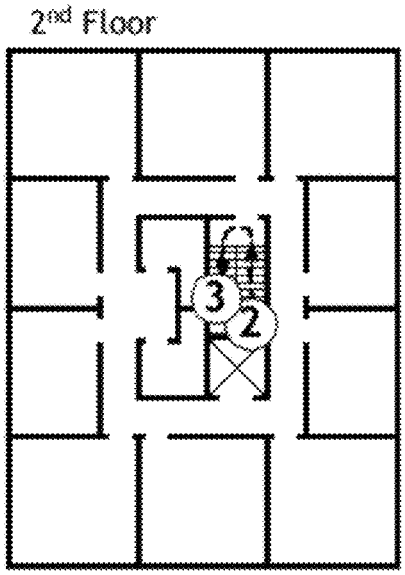
FIG. 5*b* describes second floor action in a hypothetical firefighter rescue operation.

In FIG. 5*b* the first firefighter continues climbing the stairwell through the second floor, starting at point "2" and rising up to the third floor at point "3."

Figure 5C:
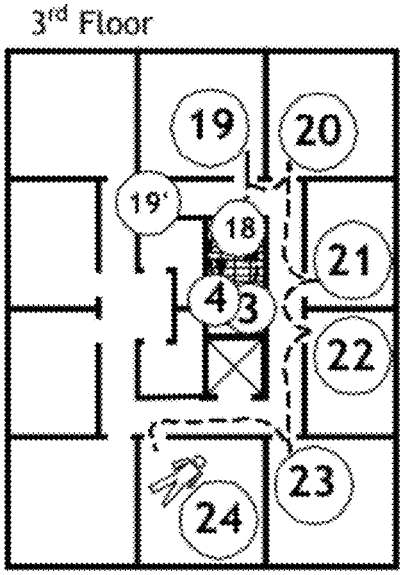
FIG. 5*c* describes third floor action in a hypothetical firefighter rescue operation.

In FIG. 5*c* the first firefighter continues climbing the stairwell through the third floor, starting at point "3" and rising up to the fourth floor at point "4."

Figure 5D:
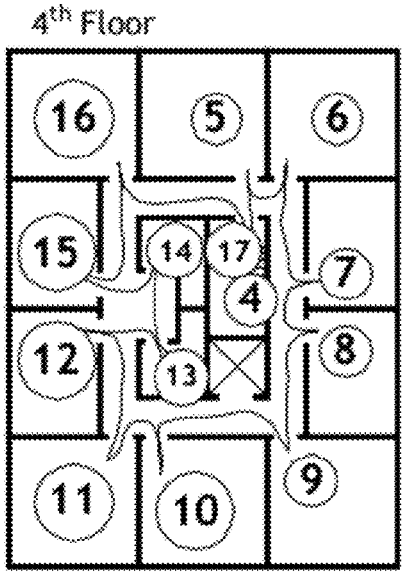
FIG. 5*d* describes fourth floor action in a hypothetical firefighter rescue operation.

In FIG. 5*d* the first firefighter continues climbing the stairwell from the third floor, starting at point "4" and exiting the stairwell. The first firefighter proceeds to clear the floor checking into each room (points "5" through "16"). Then the first firefighter exits the fourth floor heading down the stairwell at point "17" to the third floor.

The first firefighter is now back on the third floor, as shown in FIG. 5*c*. The first firefighter begins to clear the third floor as indicated by points "19" through "23." At point "24" the firefighter becomes injured and calls out for assistance. A rescuer enters the building.

FIGS. 6*a*-6*k* show eleven status displays corresponding to various stages of a hypothetical firefighter rescue operation. These display show representative data that can be used in guiding the rescuer to the first firefighter as described in FIGS. 5*a*-5*d*.

Unique tracking algorithms enable innovative techniques for displaying location information, as described in "Electromagnetic location and display system and method," (Ser. No. 11/500,660, filed Aug. 8, 2006, now U.S. Pat. No. 7,538,715, issued May 26, 2009), which is incorporated herein by reference in its entirety. In the present application, Applicants display location information including uncertainty in location information along an arbitrary path by employing a bar chart.

Figures 6A, 6B, 6C, 6D, 6E, 6F, 6G, 6H, 6I, 6J, 6K:
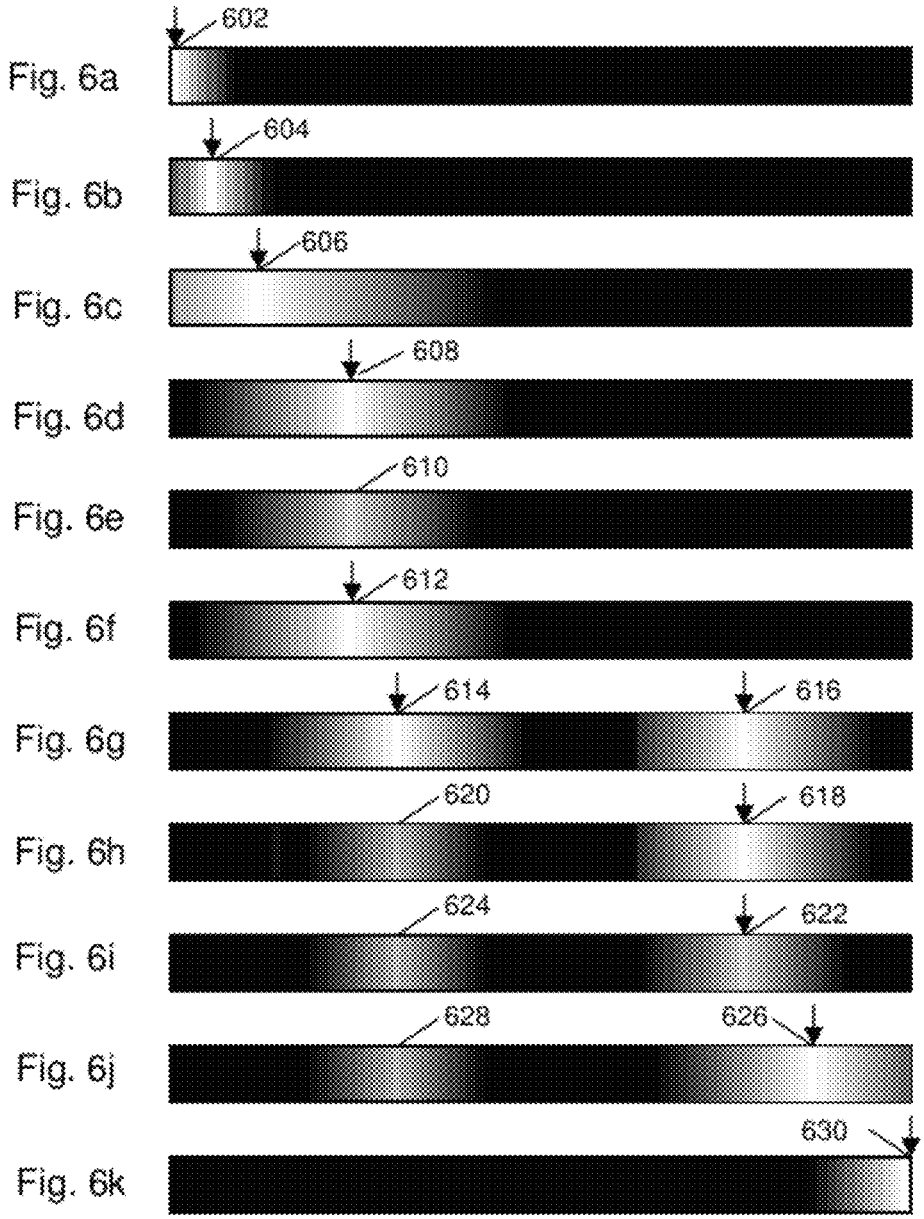
FIG. 6*a*-FIG. 6*k* show eleven status displays corresponding to various stages of a hypothetical firefighter rescue operation.

FIG. 6*a* shows the rescuer at point "1" of FIG. 5*a* where signal characteristic data were initially collected for the first firefighter. Because the signal characteristics generated by the rescuer's Tag Transmitter are virtually identical to the signal characteristics generated by the first firefighter's Tag Transmitter at the same location, the bar display shows a bright bar 602 denoted by the arrow (peak 602 of the curve in FIG. 7*a*). The bright bar represents nearly perfect match between the present received properties and the historical information. The quality of the match decreases with distance as indicated by the adjacent darker bars.

There are two routes to the stairwell on the first floor (shown in FIG. 5*a*). Suppose the rescuer happens to traverse the same route as the first firefighter.

FIG. 6*b* shows the rescuer traversing the same path as the first firefighter with a good quality solution. The bar display shows a clear and distinct bright bar 604 denoted by the arrow.

FIG. 6*c* shows the rescuer in the stairwell at point "2." The bar display shows a solution that is more spread out and diffuse. The uncertainty in following the path is now greater. However an indication 606 is provided that the rescuer is now along the same route as that taken by the first firefighter as denoted by the arrow.

FIG. 6*d* shows the rescuer on the second floor (between points "2" and "3"). Peak response at 608, farther along the path than FIG. 6.

FIG. 6*e* shows the rescuer on the second floor, just outside the stairwell. There is a vague indication 610 that the rescuer might be in the vicinity of the path. Because of the relatively weak peak indication 610, the rescuer may conclude that the path is close, but not here. Since there is no indication that the first firefighter came this way the rescuer re-enters the stairwell.

FIG. 6*f* shows the rescuer on the second floor (between points "2" and "3"). There is a clear indication 612 that the rescuer is on the trail of the first firefighter, as denoted by the arrow.

FIG. 6*g* shows the rescuer on the third floor at point "18." The display shows a bifurcated solution 614, 616. If the rescuer were to continue up the stairwell to the fourth floor, the early solution 614 in display "g" would continue to move forward while the later solution 616 would move backward. This is an indication that the first firefighter has traversed this path twice and in climbing the stairwell to the fourth floor one is traveling backwards along the most recent trail. However the double-valued solution is strong indication that the area has already been cleared—there is a "goes-in" path 614 and a "goes-out" path 616. The rescuer exits the stairwell to try to pick up the trail on the third floor.

FIG. 6*h* shows the rescuer on the third floor between points "18" and "19." There is a vague indication 620 of proximity to a solution early in the first firefighter's trail, and a solid indication 618 later in the first firefighter's trail, as denoted by the arrow.

FIG. 6*i* shows the rescuer on the third floor at point "19'." There are weak indications 624, 622 of solutions as denoted by the question marks, but the rescuer is off the path. The rescuer tries the other direction.

FIG. 6*j* shows the rescuer progressing clockwise around the floor along the same path taken by the first firefighter. Again, there is a weak indication 628 of an earlier passage in the vicinity, as denoted by the question mark. The strong indication 626 denoted with the arrow shows that the rescuer is not only on the trail of the first firefighter, but nearing the location at which the firefighter requested assistance as determined by the peak response 626 being near the end of the path.

FIG. 6*k* shows the rescuer has reached the immediate vicinity of the first firefighter as indicated by the peak indication 630 at the end of the path. In proof-of-concept experimentation, the inventors have discovered that vectoring to within five feet of the desired location is typical.

FIG. 7*a*-FIG. 7*k* illustrate the comparison sets described and shown with FIGS. 6*a*-6*k* except that FIGS. 7*a*-7*k* utilize an alternative graphical display showing the comparison value plotted as a graph relative to the path variable (e.g. time). In still further embodiments, an audio cue may be separately or in addition to the visual displays. The audio cue may be driven by the comparison value. For example, FIG. 7*a*-7*k* might represent a dependence of amplitude or frequency versus time for a chirp or other audio cues employed in conjunction with an audio interface.

Signals of Opportunity

The same approach herein disclosed of comparing live signal characteristics to reference signal characteristics along an arbitrary path may be employed in conjunction with a location system using signals-of-opportunity as previously discussed.

Display

FIG. 10 illustrates an exemplary rescuer display 112 and graphical user interface for use in association with a transmit tag or receiver tag system embodiment. The rescuer display 112 may include one or more of the displays shown. Alternative displays may be provided. The exemplary rescuer display 112 includes a signal comparison display 110 as previously illustrated in FIG. 6*a*-6*f*. The rescuer display 112 may optionally also include an orientation display 1010 giving firefighter magnetic direction orientation vs. path, and may optionally include an altitude display 1012 giving firefighter barometric altitude as a function of path.

Two types of path compare are shown. Above each display a cursor 1002 is shown. At the right of each display is digital readout 1006 of the value of the associated display at the cursor location and the cursor location value 1004. A set of controls 1014 is provided to adjust curser locations. The up-down arrows 114 select the cursor, and the right left arrows 114 move the selected cursor.

An optional magnetic compass heading display 1010 is shown. The magnetic compass value is indicative of the direction the firefighter was facing at the time. This would typically also indicate the most likely direction to find progressively advanced path locations, i.e., the firefighter would normally be walking forward.

An optional altitude 1012 display is shown. This may be from a pressure altitude sensor or other altitude sensor. The altitude value may help resolve which floor matches the path. For example, a weak indication associated with a wrong altitude may indicate that the rescuer should check the next floor for a stronger path match. In one embodiment, the heading and/or altitude as well as other matching data may be included as one of the variables in the comparison calculation for display (Equation 1).

The present invention is well suited for use in conjunction with alternate RTLS approaches. In a complicated or extensive emergency response setting, a zone or low accuracy RTLS can vector rescuers to a general area where FLARE can be used to pick up the trail of a firefighter needing assistance and guide a rescuer to his location. In addition, the present invention may be employed in conjunction with a system for homing in on a firefighter requiring assistance at short ranges typically less than 100 meters, often less than 30 meters, or on the order of 10 meters or less.

The present invention may employ a frequency allocation system whereby frequencies of FLARE Tag Transmitters may be reassigned, for instance, to place the frequency of a Tag Transmitter carried by a rescuer near the frequency of a Tag Transmitter carried by a firefighter requiring assistance. Alternatively, a time division multiple access method may be employed so that at least the first tag and rescuer tag utilize the same frequency. Additional tags may also utilize the same frequency.

The present invention is well-suited for other applications in addition to fire fighting, including tracking military or other emergency operations, guidance of animals or autonomous vehicles. The present invention may also aid firefighters in retracing their steps out of a building or incident scene in support of an evacuation or other clearance operation.

Applicants have presented specific applications and instantiations throughout the present disclosure solely for purposes of illustration to aid the reader in understanding a few of the great many implementations of the present invention that will prove useful. It should be understood that, while the detailed drawings and specific examples given describe preferred embodiments of the invention, they are for purposes of illustration only, that the system of the present invention is not limited to the precise details and conditions disclosed, and that various changes may be made therein without departing from the spirit of the invention, as defined by the following claims:

What is claimed is:

1. A rescue system comprising:

at least one mobile tag to be carried by a person potentially in need of rescue;

one or more fixed devices, each of said one or more fixed devices in radio frequency communication with said at least one mobile tag;

said rescue system configured for determining mobile tag signal property measurements indicative of electromagnetic propagation between said at least one mobile tag and said one or more fixed devices;

said rescue system further comprising a database, said rescue system configured for storing said mobile tag signal property measurements in said database in association with a path variable indicative of a path taken by said at least one mobile tag;

said rescue system further comprising a rescue tag to be carried by a rescuer;

each of said one or more fixed devices in radio frequency communication with said rescue tag;

said rescue system configured for determining rescue tag signal property measurements indicative of electromagnetic propagation between said rescue tag and said one or more fixed devices;

said rescue system configured for comparing said rescue tag signal property measurements with said mobile tag signal property measurements from said database to determine a comparison data set indicating a relative position of said rescue tag to said path taken by said at least one mobile tag.

2. The rescue system of claim 1, wherein said at least one mobile tag comprises a transmitter tag.

3. The rescue system of claim 1, wherein said at least one mobile tag comprises a receiver tag.

4. The rescue system of claim 1, wherein the path variable comprises time elapsed or distance traveled.

5. The rescue system of claim 1, further including a comparison display indicative of said comparison data set.

6. The rescue system of claim 5, wherein the comparison display comprises a graph of comparison values within said comparison data set as a function of said path variable.

7. The rescue system of claim 5, wherein the comparison display comprises a color bar display of comparison values within said comparison data set as a function of said path variable.

8. The rescue system of claim 7, wherein the color bar display comprises a gray scale display.

9. The rescue system of claim 1, further including an audio indicator configured to issue an audio indication responsive to said comparison data set.

10. The rescue system of claim 1, wherein said rescue system is configured to utilize a comparison of two signal properties of said mobile tag signal property measurements.

11. The rescue system of claim 10, wherein said comparison of two signal properties comprises E-field phase compared with H-field phase or E-field magnitude compared with H-field magnitude.

12. The rescue system of claim 1, further including a command post in radio frequency communication with said at least one mobile tag and said rescue tag, wherein said database is stored at said command post.

13. The rescue system of claim 1, wherein said rescue tag includes a copy of said database and said rescue tag is configured for comparing said database with said rescue signal property measurements to determine said comparison data set.

14. The rescue system of claim 1, wherein said comparison data set is determined using an error vector calculation.

15. A rescue method comprising:

providing a person with a mobile tag carried by said person;

said person traversing a path in accordance with at least one path variable;

providing one or more fixed devices in radio frequency communication with said mobile tag;

determining mobile tag signal property measurements and recording said signal property measurements in a database, said signal property measurements recorded in association with a path variable, said path variable indicative of a path taken by said mobile tag, said mobile tag signal property measurements indicative electromagnetic propagation between said mobile tag and said one or more fixed devices;

providing a rescuer with a rescue tag carried by said rescuer;

said rescuer tag in radio frequency communication with said one or more fixed devices;

determining rescue tag signal property measurements, said rescue tag signal property measurements indicative of electromagnetic propagation between said rescue tag and said one or more fixed devices;

comparing said rescue tag signal property measurements with said mobile tag signal property measurements from said database to determine a comparison data set indicating a relative position of said rescue tag to said path taken by said at least one mobile tag.

16. The rescue method of claim 15, wherein said mobile tag comprises a transmitter tag.

17. The rescue method of claim 15, wherein said mobile tag comprises a receiver tag.

18. The rescue method of claim 15, wherein the path variable comprises time elapsed or distance traveled.

19. The rescue method of claim 15, wherein said comparing step includes determining said comparison data set using an error vector calculation.

20. The rescue method of claim 19, wherein the error vector calculation is based on a sequence over a path variable interval of a weighted summation over a set of received signals at a particular path variable value of the squared difference between each corresponding mobile tag signal property measurement and rescue tag signal property measurement.

21. The rescue method of claim 15, further including: displaying a graph of the comparison value as a function of path location.

22. The rescue method of claim 15, further including: displaying a color bar wherein the color represents the comparison value as a function of path location.

23. The rescue method of claim 15, further including: generating an audio signal associated with the second transmitter tag indicative of the comparison value.

24. The rescue method of claim 15, further including: intercepting the said path taken by said at least one mobile tag.

25. The rescue method of claim 15, further including: detecting a crossing of the path of the first tag by observing a double peak comparison value response as a function of the path variable.

26. The rescue method of claim 15, further including: short cutting the path of the first transmit tag by following a later peak response of a double peak comparison response.

27. The rescue method of claim 15, further including: sending multiple rescue tags to look for said path taken by said at least one mobile tag.

* * * * *